US011325050B2

(12) United States Patent
Womack

(10) Patent No.: US 11,325,050 B2
(45) Date of Patent: May 10, 2022

(54) RECONFIGURABLE TOY VEHICLE LAUNCHER

(71) Applicant: Mattel, Inc., El Segundo, CA (US)

(72) Inventor: Dustee Womack, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 604 days.

(21) Appl. No.: 16/124,759

(22) Filed: Sep. 7, 2018

(65) Prior Publication Data

US 2020/0078696 A1 Mar. 12, 2020

(51) Int. Cl.
*A63H 17/00* (2006.01)
*A63H 17/05* (2006.01)

(52) U.S. Cl.
CPC ..... *A63H 17/008* (2013.01); *A63H 17/05* (2013.01)

(58) Field of Classification Search
CPC ..... A63H 17/008; A63H 17/045; A63H 17/05
USPC ..... 446/429
See application file for complete search history.

(56) References Cited

U.S. PATENT DOCUMENTS 2,201,910 A 5/1940 Meienborn
2,311,123 A 2/1943 Vivian
2,517,084 A 8/1950 Carver
2,797,922 A 7/1957 Thompson
2,820,321 A * 1/1958 James ..... A63H 27/14 446/63
2,993,297 A * 7/1961 Bednar ..... A63H 27/005 446/197
3,039,229 A 6/1962 Cleemput
3,240,201 A * 3/1966 Shelton ..... A63H 33/00 124/17
3,363,362 A 1/1968 Jolley
3,392,484 A 7/1968 Ryan
3,513,658 A * 5/1970 Kisaburo ..... A63H 30/06 60/581
3,594,951 A 7/1971 Perhacs, Jr.
3,664,670 A 5/1972 Glass
3,675,366 A 7/1972 Tomiyama
3,693,282 A 9/1972 Adicks
3,740,896 A * 6/1973 Glass ..... A63H 29/24 446/212
3,770,272 A 11/1973 Olivier
3,797,164 A 3/1974 Glass
3,877,169 A 4/1975 Munday
3,895,459 A 7/1975 Morrison
3,908,303 A 9/1975 McKay
3,936,053 A * 2/1976 Goldfarb ..... A63H 27/14 273/108
4,016,674 A 4/1977 Resnick
(Continued)

*Primary Examiner* — Joseph B Baldori
(74) *Attorney, Agent, or Firm* — Edell, Shapiro & Finnan, LLC

(57) ABSTRACT

A reconfigurable toy vehicle launcher includes a first portion and a second portion. The first portion includes at least a portion of a launching mechanism. The second portion includes a compartment configured to receive a set of launchable toy vehicles and is reconfigurable with respect to the first portion. In particular, the second portion is reconfigurable between a first position in which the launching mechanism can sequentially launch the set of launchable toy vehicles away from the toy and a second position in which the first portion and the second portion provide a toy or a storage solution.

20 Claims, 11 Drawing Sheets

(56) References Cited

U.S. PATENT DOCUMENTS 4,076,006 A * 2/1978 Breslow ..... A63H 27/14 124/64
4,087,935 A 5/1978 Edmisson
4,090,321 A * 5/1978 Ogawa ..... A63H 3/52 446/7
4,108,437 A 8/1978 DeAnda
4,155,194 A 5/1979 Amamoto
4,159,705 A * 7/1979 Jacoby ..... F41B 11/66 124/63
4,174,587 A 11/1979 Morin
4,188,748 A 2/1980 Rich
4,203,247 A 5/1980 Moe
4,227,508 A 10/1980 D'Andrade
4,236,345 A * 12/1980 Inoue ..... A63H 17/006 446/197
4,249,339 A 2/1981 Crain
4,267,661 A * 5/1981 Hanson ..... A63H 17/008 124/21
4,282,848 A 8/1981 Kulesza
4,304,066 A 12/1981 Brand
4,345,402 A 8/1982 Hanson
4,366,645 A 1/1983 Crain
4,372,075 A 2/1983 Harkins
4,373,290 A 2/1983 Goldfarb
4,382,347 A * 5/1983 Murakami ..... A63H 17/045 446/433
4,403,440 A 9/1983 Wulff
4,433,504 A * 2/1984 Terui ..... A63H 17/44 446/429
4,438,587 A * 3/1984 Marino ..... A63H 17/008 446/202
4,472,906 A * 9/1984 Cook ..... A63H 17/008 124/79
4,475,303 A 10/1984 Ribas
4,504,242 A 3/1985 Crain
4,513,967 A * 4/1985 Halford ..... A63F 7/2409 273/108
4,516,948 A 5/1985 Obara
4,516,952 A 5/1985 Brand
4,599,078 A 7/1986 Obara
4,605,230 A 8/1986 Halford
4,642,066 A 2/1987 Kennedy
4,708,683 A 11/1987 Lehmann
4,732,569 A * 3/1988 Hippely ..... A63H 17/008 446/430
4,737,135 A 4/1988 Johnson
4,869,700 A 9/1989 Reiling, Jr.
5,052,680 A 10/1991 Malewicki
5,141,467 A 8/1992 Crosbie
5,173,071 A 12/1992 Hoeting
5,232,393 A 8/1993 Brown
5,254,030 A * 10/1993 Ostendorff ..... A63H 18/026 124/26
5,316,514 A 5/1994 Ellman
5,370,571 A 12/1994 Bosch
5,390,653 A 2/1995 Lee
5,460,560 A 10/1995 Liu
5,619,977 A 4/1997 Gatin
5,676,120 A 10/1997 Joseph
5,711,285 A 1/1998 Stewart
5,924,910 A 7/1999 Liu
6,000,992 A * 12/1999 Lambert ..... A63H 18/026 446/430
6,089,215 A 7/2000 Morris
6,106,356 A * 8/2000 Trageser ..... A63H 17/006 446/429
6,371,871 B1 4/2002 Rappaport
6,786,795 B1 9/2004 Mullaney
7,156,085 B2 1/2007 Lewis
7,226,372 B2 6/2007 Flanigan
7,442,109 B2 10/2008 Fosbenner
7,614,931 B2 * 11/2009 Nuttall ..... A63H 18/026 446/423
7,942,720 B1 * 5/2011 Galoustian ..... A63H 3/02 446/298
7,942,721 B2 * 5/2011 Wade ..... A63H 33/009 446/473
7,950,977 B2 * 5/2011 Sun ..... A63H 17/21 446/435
8,011,994 B2 * 9/2011 Fink ..... A63H 18/026 446/429
8,298,038 B2 * 10/2012 O'Connor ..... A63H 18/02 446/444
8,376,806 B2 2/2013 Sun
8,449,344 B2 5/2013 Nuttall
8,668,081 B2 3/2014 Hippely
8,801,492 B2 8/2014 O'Connor
D734,403 S * 7/2015 Womack ..... D21/565
9,097,476 B2 * 8/2015 Mead ..... F41A 9/63
9,127,900 B2 * 9/2015 Hudson ..... F41B 7/08
9,427,671 B2 * 8/2016 O'Connor ..... A63H 17/008
9,731,210 B2 * 8/2017 Lennon ..... A63H 17/008
9,822,736 B2 * 11/2017 Roehr ..... E02D 3/046
10,758,833 B2 * 9/2020 Hamel ..... A63H 17/008
10,857,474 B2 * 12/2020 Schmid ..... A63H 17/008
2003/0224694 A1 12/2003 Hoeting
2004/0009734 A1 1/2004 Needham
2007/0089632 A1 * 4/2007 Gordon ..... A63G 7/00 104/53
2008/0020675 A1 1/2008 Ostendorff
2008/0070472 A1 3/2008 Campbell
2010/0330873 A1 12/2010 McCafferty
2012/0270472 A1 10/2012 Sandoval
2013/0078887 A1 * 3/2013 Payne ..... A63H 33/22 446/429
2014/0051325 A1 * 2/2014 Paukert ..... A63H 33/003 446/297
2014/0057526 A1 * 2/2014 Sheltman ..... A63H 17/008 446/429
2014/0099859 A1 4/2014 Weil
2014/0256219 A1 * 9/2014 Lennon ..... A63H 17/008 446/429
2020/0078696 A1 * 3/2020 Womack ..... A63H 17/05

* cited by examiner

RECONFIGURABLE TOY VEHICLE LAUNCHER

FIELD OF THE INVENTION

The present invention relates to a toy vehicle launcher, and in particular, to a reconfigurable toy vehicle launcher that can retain toy vehicles and launch the toy vehicles in rapid succession.

BACKGROUND OF THE INVENTION

Often, when children play and interact with toy vehicles, children push the toy vehicles manually. For example, children may "launch" toy vehicles by pushing and releasing toy vehicles, causing the vehicle to travel across a support surface. Alternatively, children may launch a toy vehicle with a toy vehicle launcher. However, typically toy vehicle launchers require a child to load and launch one toy vehicle before loading and launching another toy vehicle. Consequently, a child must load a vehicle each time the child wants to launch a vehicle.

In view of at least these issues, U.S. Pat. No. 9,731,210 to Berrigan Lennon, filed Apr. 20, 2012, and entitled "Toy Vehicle Launcher," the entire disclosure of which is incorporated by reference herein, introduced a toy vehicle launcher designed to hold and sequentially launch a plurality of vehicles. Thus, this toy vehicle launcher resolves issues associated with launchers that require constant reloading. However, this toy vehicle launcher does not provide a toy, such as a toy vehicle, in and of itself. Thus, the toy vehicle launcher may have limited play value if a user does not possess launchable toy vehicles. That is, the launcher is not reconfigurable into a play configuration (e.g., a configuration where the launcher resembles a toy vehicle suitable for play on its own). Moreover, this toy vehicle launcher is also not reconfigurable into a storage configuration that allows the launcher to safely transport launchable toy vehicles without risk of launching the launchable toy vehicles. Consequently, reconfigurable toy vehicle launchers that can launch toy vehicles in rapid succession in one configuration and provide play or storage value in another configuration are desired.

SUMMARY OF THE INVENTION

The present disclosure is directed to a reconfigurable toy vehicle launcher. In one embodiment, a toy vehicle launcher includes a first portion and a second portion. The first portion includes at least a portion of a launching mechanism. The second portion includes a compartment configured to receive a set of launchable toy vehicles and is reconfigurable with respect to the first portion. In particular, the second portion is reconfigurable between a first position in which the launching mechanism can sequentially launch the set of launchable toy vehicles and a second position in which the first portion closes the compartment.

In at least some of these embodiments, the first portion and the second portion resemble a toy vehicle when the second portion is disposed in the second position. This may ensure that the toy vehicle launcher provides play value it at least some configurations. For example, the first portion may be a tractor unit, the second portion may be a semi-trailer, and the toy may resemble a tractor-trailer when the semi-trailer is in the second position so that the reconfigurable toy vehicle launcher has play value as a tractor-trailer. Additionally or alternatively, the toy vehicle launcher may be inoperable when the second portion is in the second position. This may prevent a child from accidentally launching a toy vehicle when the second portion is in the second position (e.g., when a child is playing with the toy vehicle launcher in a toy configuration and/or transporting launching vehicle toy vehicles within the toy vehicle launcher).

Additionally, in some embodiments of the toy vehicle launcher described above, the launching mechanism includes an actuator and a kicker. In response to a sequential actuation of the actuator, the kicker extends into a launching area defined by at least the second portion when the second portion is in the first position. Extension of the kicker into the launching area launches a particular toy vehicle of the set of launchable toy vehicles that is disposed in the launching area. In some of these embodiments, the launching mechanism also includes an engagement member and the second portion includes a set of arms. In these embodiments, the engagement member actuates the set of arms in response to the sequential actuation of the actuator to cause the arms to prevent toy vehicles of the set of launchable toy vehicles disposed above the particular toy vehicle from falling downwards into the launching area during the sequential actuation. Still further, in some embodiments, the launching mechanism includes a retainer panel configured to retain the particular toy vehicle in the launching area until the actuator is actuated. These features, or combinations thereof, may ensure that the launching mechanism can effectively launch toy vehicles in response to sequential actuations.

Still further, in some embodiments of the toy vehicle launcher described above, the first portion includes a depressible portion and, when the second portion is in the first position, sequential depressions of the depressible portion cause the launching mechanism to sequentially launch the set of launchable toy vehicles along the first portion and away from the toy vehicle launcher. This may allow a child to easily sequentially launch vehicles by smacking or slapping a top of the first portion. That is, this feature may enable they toy vehicle launcher to function as a "slam launcher."

Moreover, in some embodiments, when the second portion is in the first position the set of launchable toy vehicles are stacked vertically within the second portion. Additionally or alternatively, the second portion may be a magazine that can be loaded with the set of launchable toy vehicles. Consequently, a child may be able to repeatedly prepare vehicles for sequential launching in a quick and easy manner.

According to another embodiment, the present disclosure is directed to a toy including a first toy vehicle and one or more second toy vehicles. The first toy vehicle includes a first portion with an actuator and a second portion that is reconfigurable with respect to the first portion between a first configuration and a second configuration. The one or more second toy vehicles are sized to fit within the second portion. When the second portion is in the first configuration the one or more second toy vehicles can be sequentially launched from the second portion in response to sequential actuations of the actuator. When the second portion is in the second configuration the one or more second toy vehicles are stored within the second portion. Thus, the toy can be used for play as a toy vehicle launcher or as a toy vehicle itself.

According to yet another embodiment, the present disclosure is directed to a toy vehicle launcher including a first portion and a second portion. The first portion includes a first part of a launching mechanism. The second portion includes a second part of the launching mechanism and a compartment configured to receive a set of launchable toy vehicles. The second portion is also reconfigurable with respect to the first portion, between a first position and a second position. When the second portion is in the first position, the first part of the launching mechanism is aligned with the second part of the launching mechanism so that the launching mechanism can sequentially launch the set of launchable toy vehicles away from the toy. When the second portion is in the second position, the first part of the launching mechanism is separated from the second part of the launching mechanism. In at least some of these embodiments, the first portion and second portion provide a toy or a storage solution when the second portion is in the second position. Additionally or alternatively, the launching mechanism may be inoperable when the second portion is in the second position.

BRIEF DESCRIPTION OF THE DRAWINGS

Like reference numerals have been used to identify like elements throughout this disclosure.

DETAILED DESCRIPTION OF THE INVENTION

Figure 1:
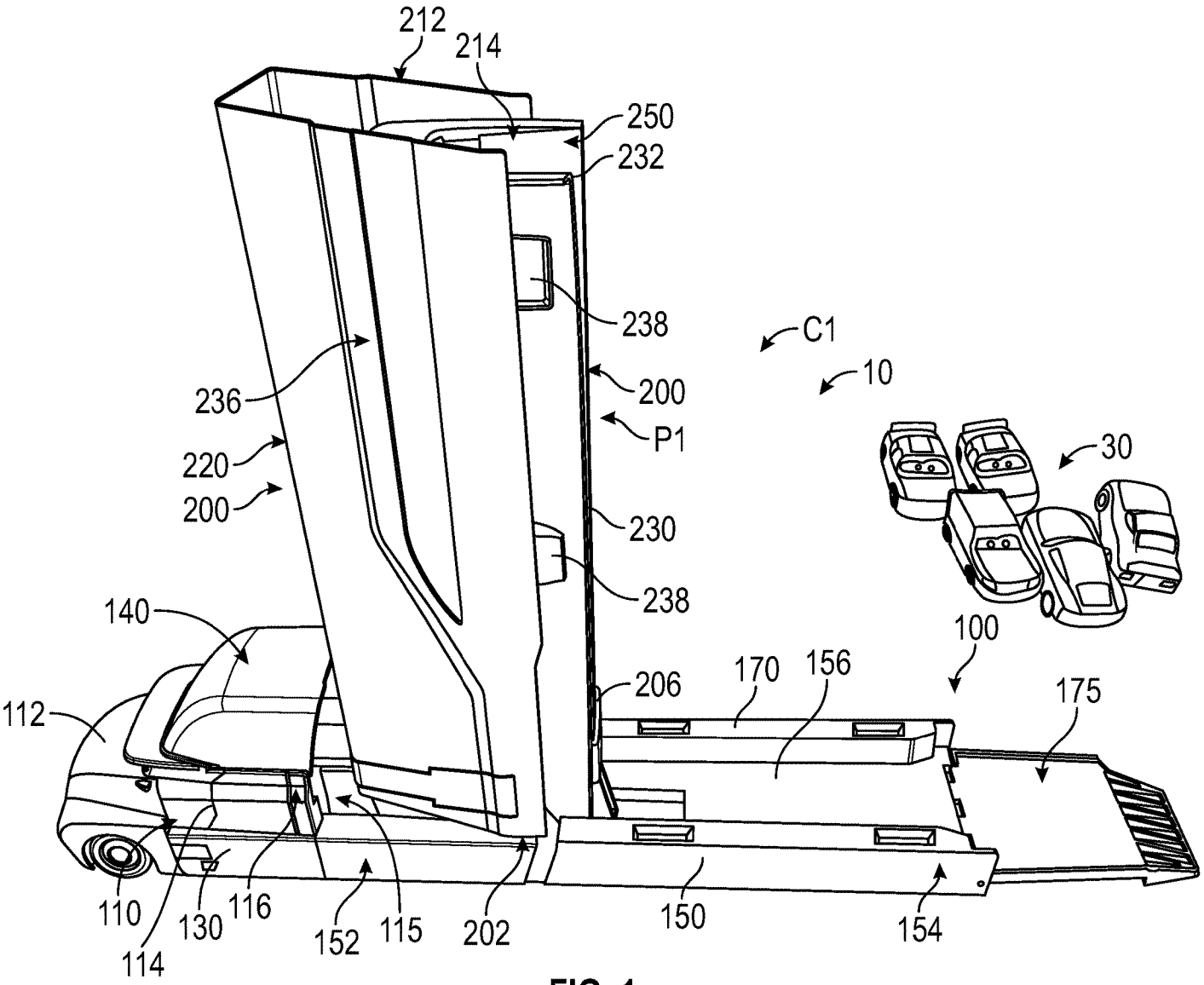
FIG. 1 illustrates a side perspective view of an embodiment of a reconfigurable toy vehicle launcher according to the present invention, with the reconfigurable toy vehicle launcher in a launcher configuration.

A reconfigurable toy vehicle launcher is presented herein. Generally, the reconfigurable toy vehicle launcher is reconfigurable between a launcher configuration and a play/storage configuration. That is, the toy vehicle launcher presented herein may be reconfigurable between a first configuration that allows a child to sequentially launch a set of launchable toy vehicles in rapid succession and a second configuration that provides play and/or storage value. Although the Figures generally depict an embodiment in which a toy vehicle launcher is reconfigurable into a toy configuration in which the toy vehicle launcher resembles a tractor-trailer, this is merely one example and, in other embodiments, the toy vehicle launcher might be reconfigurable into a train, a plane, a figurine, or any other type of toy. Additionally or alternatively, the toy vehicle launcher may be reconfigurable into a carrying case or other such storage solution.

The reconfigurable toy vehicle launcher may provide storage value in the second configuration at least because launchable toy vehicles cannot be launched when the reconfigurable toy vehicle launcher is disposed in the second configuration. That is, the reconfigurable toy vehicle launcher may be reconfigurable into a storage configuration that allows a child to transport the toy vehicle launcher without accidentally launching vehicles. Moreover, in embodiments where the second configuration is a toy configuration, such as the tractor-trailer configuration illustrated in the Figures, the reconfigurable toy vehicle launcher also provides play value in its second configuration at least because a child may play with the reconfigurable toy vehicle launcher as a toy without any launchable toy vehicles. Alternatively, although not illustrated, in at least some embodiments, the second configuration may be a storage configuration (as opposed to a toy configuration) that provides storage value without providing play value. For example, the reconfigurable toy vehicle launcher may be reconfigurable into a carrying case or another such storage solution.

Regardless of the specific arrangement of the second configuration (e.g., regardless of whether the second configuration is a toy configuration or storage configuration), when the reconfigurable toy vehicle launcher provided herein is disposed in the first configuration (e.g., the launcher configuration), the reconfigurable toy vehicle launcher can sequentially launch a set of launchable toy vehicles (e.g., die cast vehicles) in rapid succession. That is, the toy vehicle launcher can launch a plurality of vehicles, one-by-one, in response to successive actuations.

As is explained in further detail below, to achieve the aforementioned features, a portion of the reconfigurable toy vehicle launcher provided herein is designed as a cartridge or magazine that feeds toy vehicles, one-by-one, into a launching area when the reconfigurable toy vehicle launcher is disposed in the launcher configuration. Once vehicles are disposed in the launching area, a launching mechanism impacts the toy vehicles to propel the toy vehicles away from the launcher. In at least some embodiments, a first portion of the reconfigurable toy vehicle launcher includes a launching mechanism that launches cars in a launching area defined, at least at part, by a magazine or cartridge portion (a second portion). Additionally or alternatively, the first portion and the second portion may cooperate to define a launching mechanism. Either way, the launching mechanism may only sequentially launch a set of launchable toy vehicles away from the toy when the first and second portions are properly aligned in the launcher configuration.

Now turning to FIG. 1, according to one example, embodiment, a reconfigurable toy vehicle launcher 10 includes a first portion 100 and a second portion 200. In the depicted embodiment, the first portion 100 resembles a tractor unit of a tractor-trailer and the second portion 200 resembles a trailer of the tractor-trailer. For example, the first portion 100 includes a cab 110 and a trailer 150. However, in other embodiments, the first portion 100 and second portion 200 may each resemble any portion of any toy or storage solution. For example, the first portion 100 could be the base of a carrying case and the second portion 200 could be a container that can be selectively secured to the base to form a portable enclosure. Still, the second portion 200 generally provides a cartridge or magazine that can be loaded with launchable toy vehicles 30, such as die cast vehicles (e.g., HOT WHEELS toy vehicles that are commercially available from MATTEL, Inc., of El Segundo, Calif.), so that the reconfigurable toy vehicle launcher 10 can sequentially launch the launchable toy vehicles 30 in rapid succession when disposed in a launcher configuration C1.

In the depicted embodiment, the cab 110 includes a front portion 112 and a rear portion 116. The cab 110 also includes sidewalls 114, a base 130, and a top 140 that extend between the front portion 112 and the rear portion 116. At least a portion of a launching mechanism 115 is disposed at or on the rear portion 116. A trailer 150 also extends rearward from the rear portion 116 of the cab 110, from a front end 152 to a rear end 154. The trailer 150 includes a rear flap 175 that is pivotally coupled to the rear end 154 and includes a floor 156 that extends from the front end 152 to the rear end 154. The floor 156 is laterally bounded by sidewalls 170.

Figure 2:
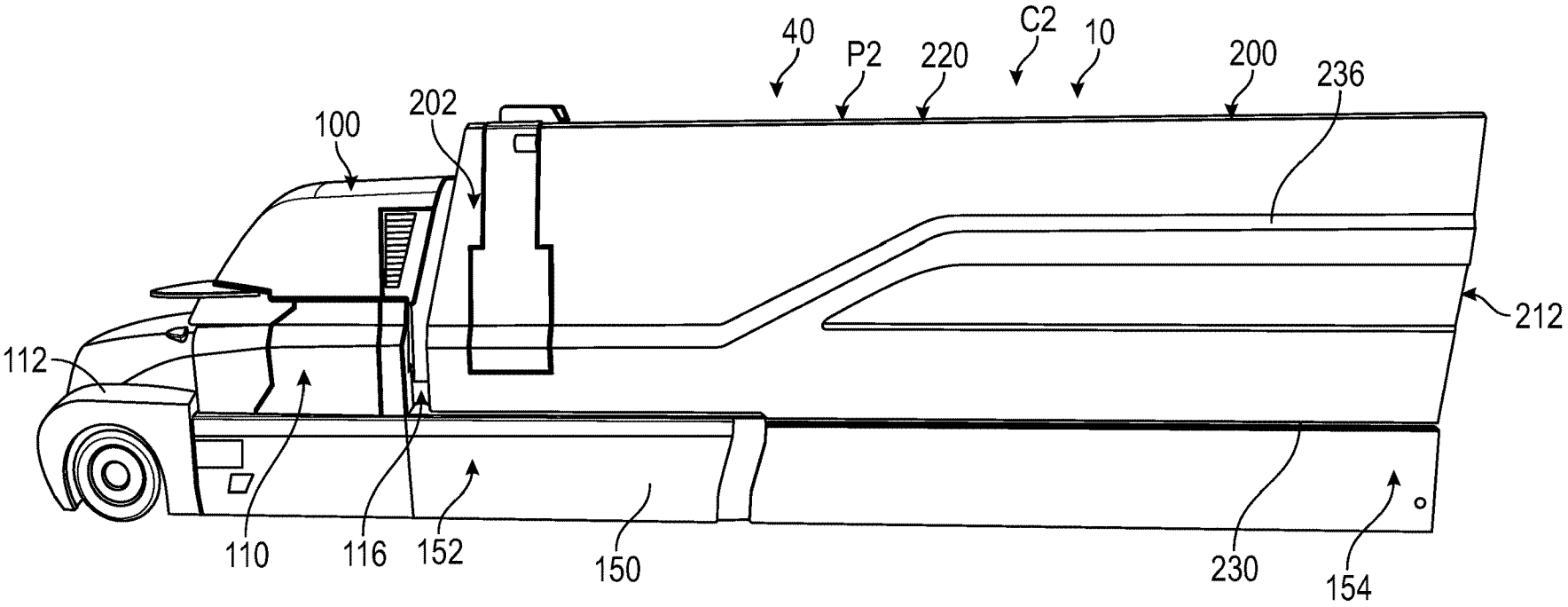
FIG. 2 illustrates a side view of the reconfigurable toy vehicle launcher of FIG. 1, with the reconfigurable toy vehicle launcher in a toy configuration.
Figure 3:
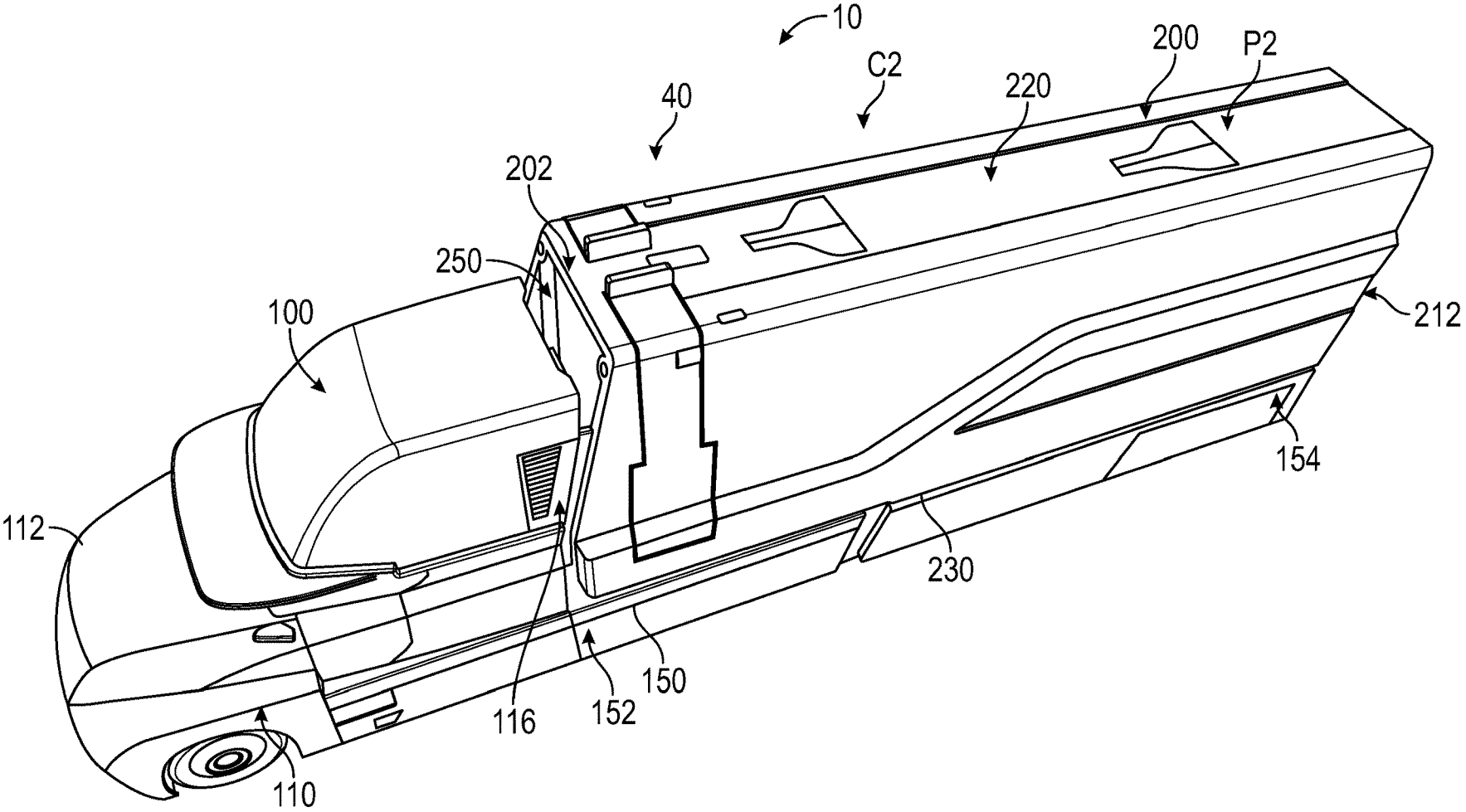
FIG. 3 illustrates a perspective view of the reconfigurable toy vehicle launcher of FIG. 1, with the reconfigurable toy vehicle launcher in a toy configuration.

Still referring to FIG. 1, but now with reference to FIGS. 2 and 3 as well, the second portion 200 (also referred to as trailer 200 despite the trailer being one example of a second portion 200) is a generally elongate portion, which, in the depicted embodiment, is approximately cuboidal. The second portion 200 is repositionable with respect to the first portion 10 but, for clarity, the second portion is described with respect to the position shown in FIGS. 2 and 3 (a trailer or toy position). For example, the second portion 200 includes a top 220, a bottom 230, and sidewalls 236 that extend from a first or front end 202 to a second or back end 212.

The second portion 200 also defines an interior compartment 250 sized to receive a plurality of the launchable toy vehicles 30. In the depicted embodiment, the bottom 230 is an open bottom and the second portion 200 also includes an inner guide 232 that extends through the interior compartment 250. The interior guide 232 is sized prevent toy vehicles 30 from exiting the interior compartment 250 via the bottom 230. However, in other embodiments, the second portion need not include an inner guide 232. For example, the bottom 230 may cooperate with the top 220 and the sidewalls 236 to form a closed or partially closed perimeter around the interior compartment 250.

Figure 7:
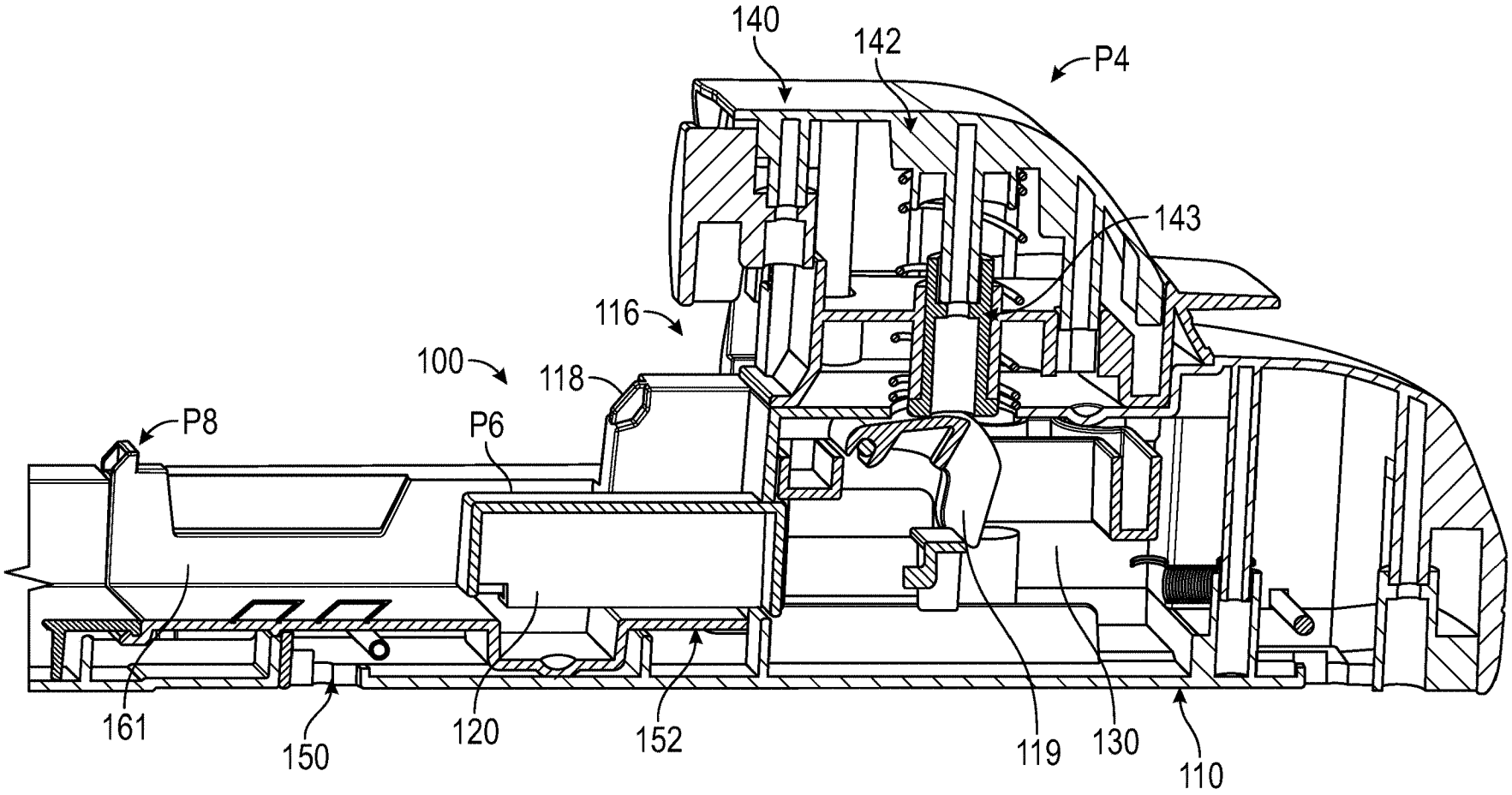
FIG. 7 illustrates a sectional view of the first portion of the reconfigurable toy vehicle launcher of FIG. 1.

In the depicted embodiment, the front end 202 and the back end 212 each define an opening that provide access to the interior compartment 250: opening 203 and opening 214, respectively (see, e.g., FIG. 7). However, in other embodiments, the front end 202 may be at least partially closed end and the bottom 230 may allow cars to exit the second portion 200 adjacent the front end 202 when the reconfigurable toy vehicle launcher 10 is in the launcher configuration 10. Put another way, in some embodiments, the second portion 200 may define a launching area 206 with the first portion 100 and in other embodiments, the second portion 200 may define a launching area 206 on its own.

In FIG. 1, the reconfigurable toy vehicle launcher 10 is in a launcher configuration C1. When the reconfigurable toy vehicle launcher 10 is disposed in the launcher configuration C1, the second portion 200 is positioned in an upright position P1 (also referred to as a magazine position). That is, the front end 202 is approximately perpendicular to the rear end 116 of the cab 110 and approximately parallel to the floor 156 of the trailer 150. However, the trailer is also adjacent the rear end 116 of the cab 110 of the first portion 100 and, thus, the trailer 200 is positioned adjacent at least a portion of the launching mechanism 115 (as is described in further detail below) when in the magazine position P1.

In the depicted embodiment, the front end 202 of the trailer 200 serves as a base that supports the second portion 200 in the upright/magazine position P1 and that cooperates with the first portion 100 to define the launching area 206 from which launchable toy vehicles 30 can be launched. When launchable toy vehicles 30 are launched from the launching area 206, the launchable toy vehicles 30 travel along the floor 156 of trailer 150 (moving towards the rear end 154) and exit the launcher 10 via the rear flap 175, which may provide a ramp from the floor 156 to a support surface on which the launcher 10 is resting. The rear flap 175 may be manually moved into a ramp position aligned with the floor 156 prior to a launch or the force of a toy vehicle 30 impacting the rear flap 175 subsequent to a launch may cause the flap 175 to pivot downwards into such a position. The back end 212 of the trailer 200 serves as a top or loading end when the trailer 200 is in the magazine position P1.

By comparison, in FIGS. 2 and 3, the toy vehicle launcher 10 is disposed in a second configuration C2 (which, again, is simply an example of a toy or storage configuration into which the toy vehicle launcher 10 may be reconfigured). In the depicted embodiment, the second configuration C2 is a toy configuration and, thus, the first portion 100 and second portion 200 cooperate to form a toy 40, which, in the depicted embodiment, is a tractor-trailer toy vehicle. Although not all of the wheels included in the toy 40 are shown (some are embedded within the trailer 150), the first portion 100 may include any number of wheels/tracks/treads/skis/etc. that allow the toy vehicle 40 to travel along a surface. Thus, the reconfigurable toy vehicle launcher 10 offers play value as a toy vehicle when in the second configuration C2.

Moreover, in the depicted second configuration C2, the front end 202 of the second portion 200 is adjacent and approximately parallel to the rear end 116 of the first portion 100 so that the two portions are abutting or nearly abutting and prevent toy vehicles 30 from exiting the trailer 200 via the front end 202. Put another way, the second portion is repositioned so that the first portion closes the front end 202 of the first portion, insofar as the term "close" means that the first portion prevents toy vehicles from exiting the front end 202 and does not necessarily require that the front end abuts and/or seals the front end 202. Meanwhile, although not shown, the flap 175 can pivot upwards to selectively close the rear end 212 of the trailer 200 when the trailer 200 is in the trailer position P2. Thus, the first portion 100 and second portion can cooperate to define a closed storage area for toy vehicles within the interior compartment 250 of the trailer 200. That is, the toy configuration C2 shown in the Figures may provide storage space for launchable toy vehicles 30 and, thus, may provide both storage value and play value to a child.

Additionally, although the front end 202 of trailer 200 is positioned relatively close to the launching mechanism 115 when the trailer 200 is in the trailer position, the first portion 100 and second portion do not form or define a launching area in the second configuration 200. Consequently, the reconfigurable toy vehicle launcher 10 is unable to launch the launchable toy vehicles 30 when disposed in the second configuration C2. That is, if the launching mechanism 115 is actuated (e.g., accidentally actuated) while the reconfigurable toy vehicle launcher 10 is in the second configuration C2, the reconfigurable toy vehicle launcher 10 will not launch any of the launchable toy vehicles 30 disposed within the interior compartment 250 of the second portion 200. Thus, if a child is using the reconfigurable toy vehicle launcher 10 to transport or store launchable toy vehicles 30 while the reconfigurable toy vehicle launcher 10 is in the second configuration C2, the child cannot accidentally launch the launchable toy vehicles 30 from the reconfigurable toy vehicle launcher 10.

Figure 4:
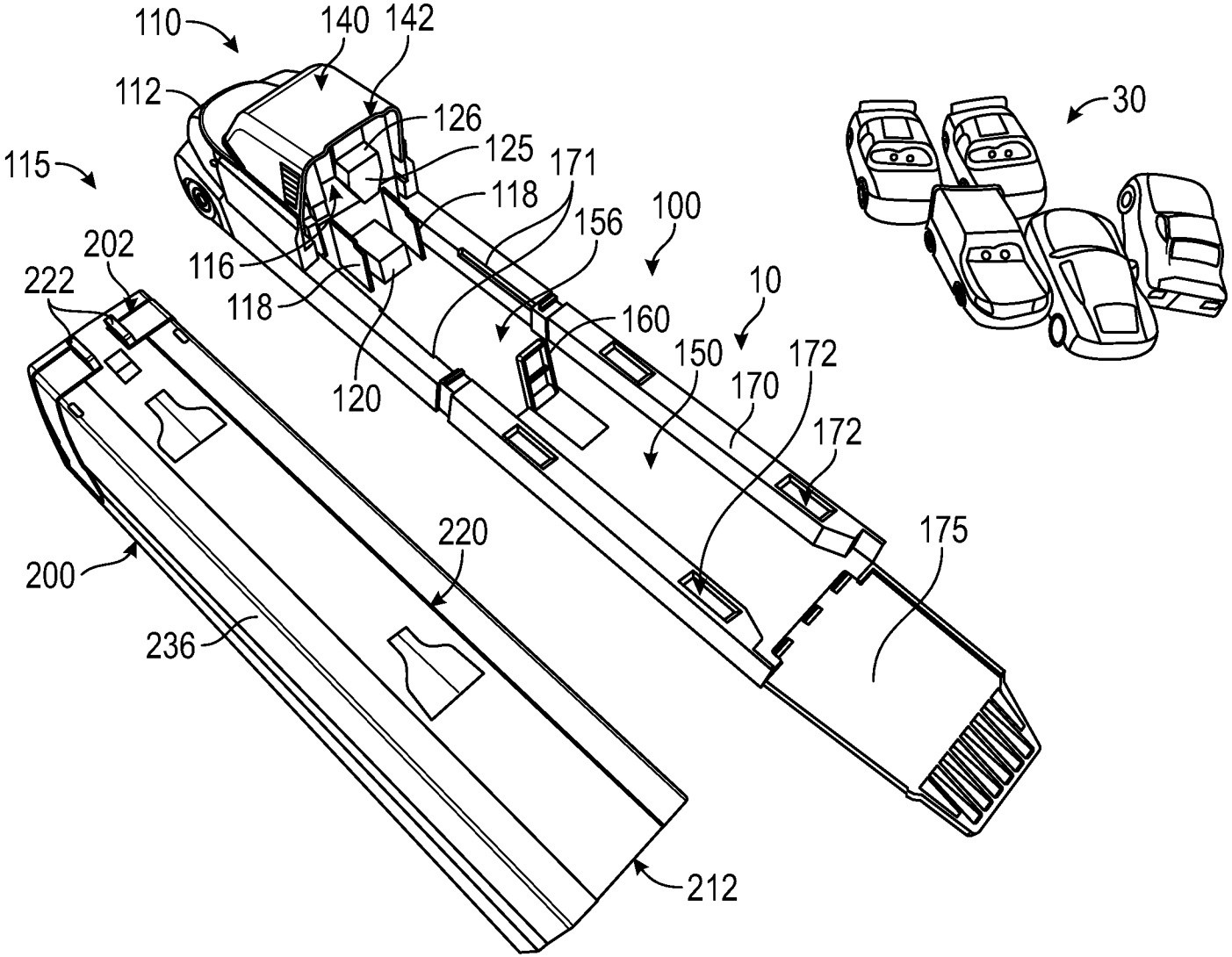
FIG. 4 illustrates a perspective view of the reconfigurable toy vehicle launcher of FIG. 1, with a second portion of the reconfigurable toy vehicle launcher removed from a first portion of the reconfigurable toy vehicle launcher.
Figure 8:
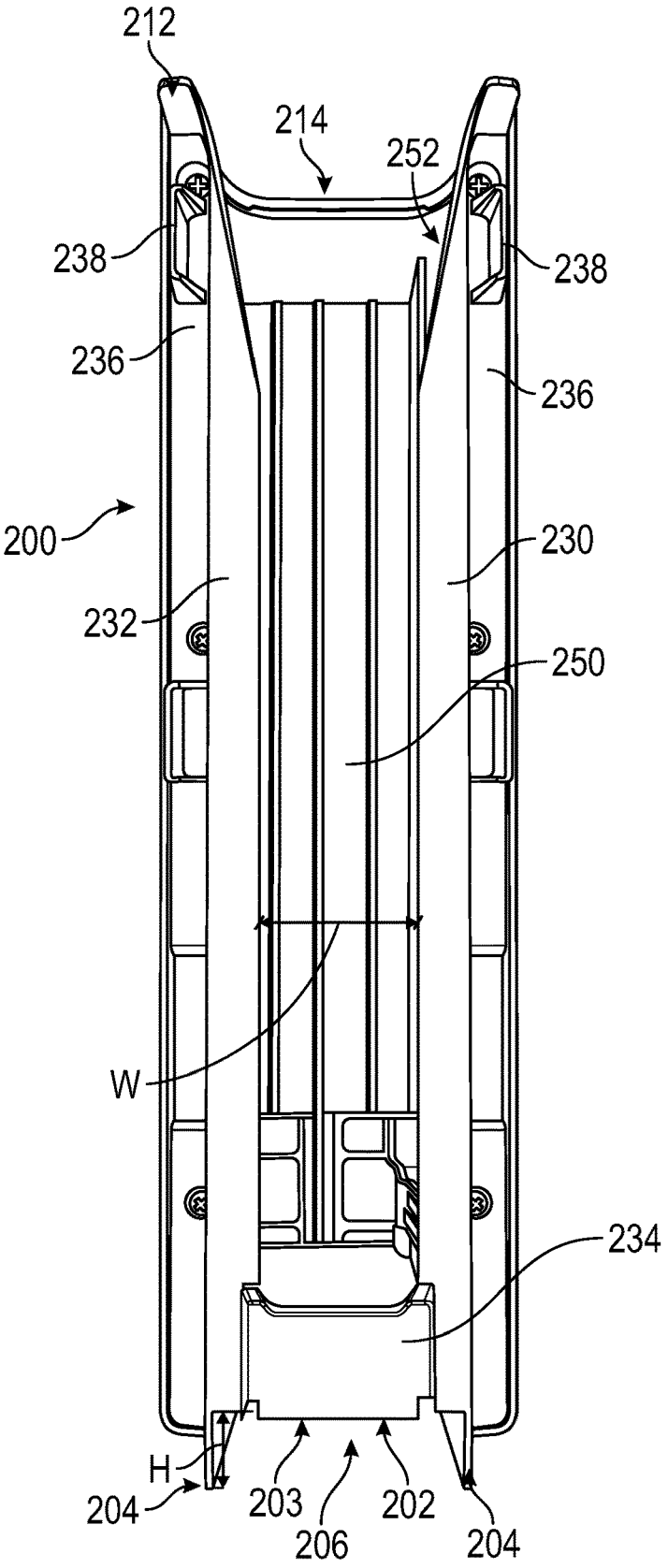
FIG. 8 illustrates a bottom view of the second portion of the reconfigurable toy vehicle launcher of FIG. 1.
Figure 10:
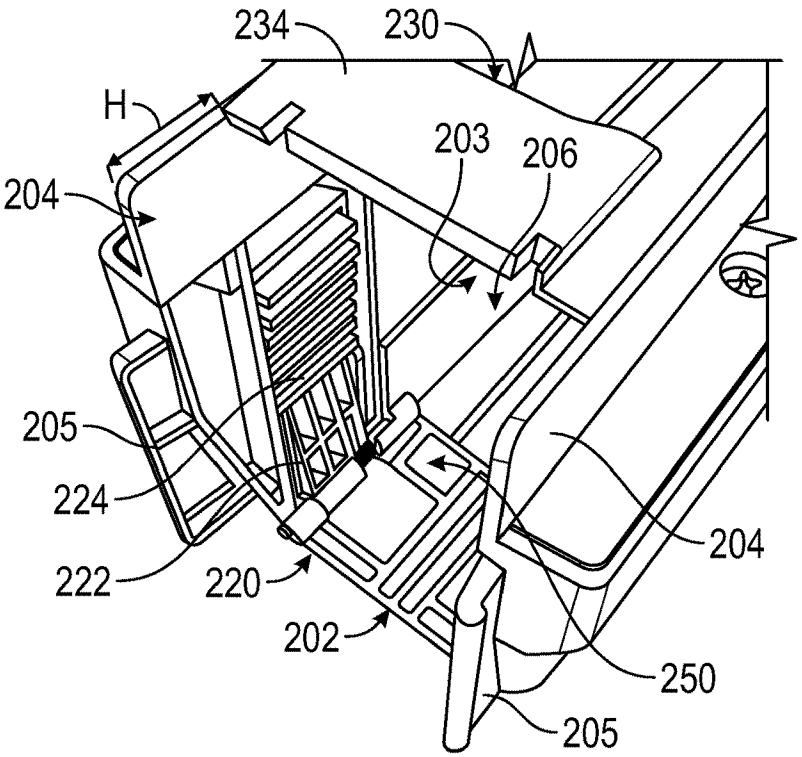
FIG. 10 illustrates a front perspective view of the front end of the second portion of the reconfigurable toy vehicle launcher of FIG. 1 while the second portion is upside-down.
Figure 9:
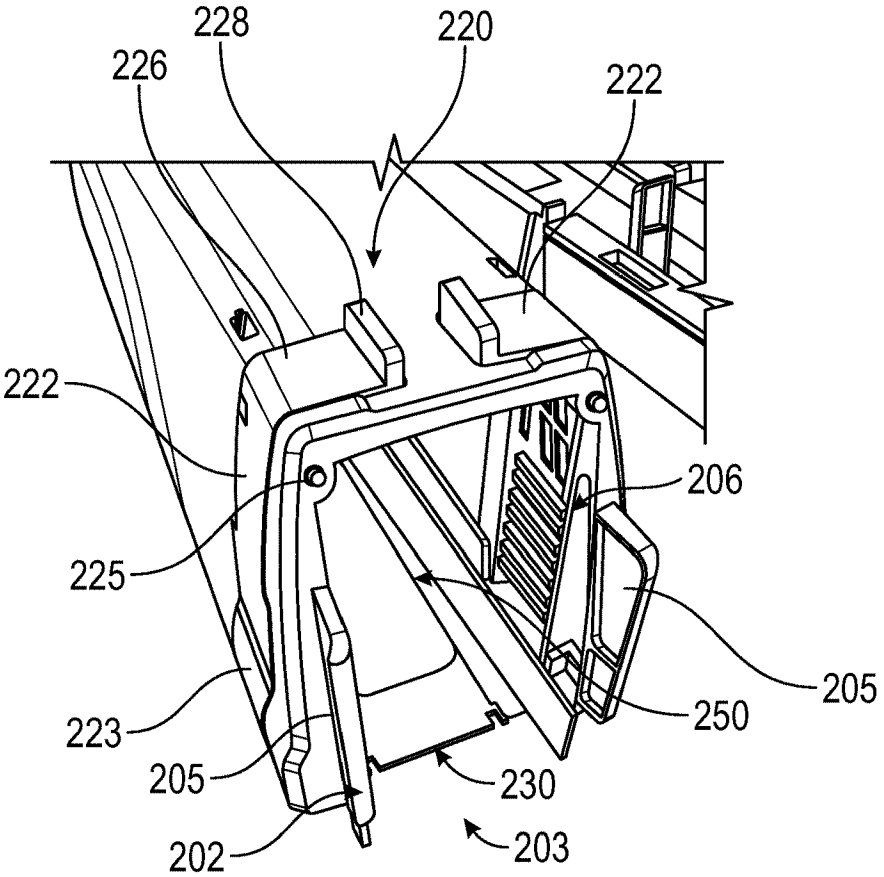
FIG. 9 illustrates a front perspective view of a front end of the second portion of the reconfigurable toy vehicle launcher of FIG. 1.

Now referring to FIGS. 1 and 4, but with reference to FIGS. 8-10 as well, the first portion 100 and the second portion 200 may each include male and female connectors that allow the second portion 200 to be removable coupled to the first portion 100 in either its first position P1 (the magazine position) or its second position P2 (the trailer position). For example, in the depicted embodiment, the first portion includes first female connectors 171 (e.g., openings) and second female connectors 172 (e.g., openings) formed in the sidewalls 170 of trailer 150 and the second portion 200 includes male connectors that can releasably mate with female connectors 171 or female connectors 172.

In particular, the second portion includes a first set of male connectors 205 (see FIGS. 8-10) that are disposed along edges of its sidewalls 236 adjacent the front end 202 and a second set of male connectors 238 disposed along edges of sidewalls 236 adjacent bottom 230 and/or edges of its bottom 230 (see FIGS. 1 and 8). The first set of male connectors 205 are configured to selectively mate with female connectors 171 (e.g., through a detent-type connection) and secure the trailer 200 to the first portion 100 in its upright first position P1 (e.g., the "magazine position") so that the toy vehicle launcher 10 is in the second configuration C1. Meanwhile, the second set of male connectors 238 are configured to selectively mate with female connectors 172 (e.g., through a detent-type connection) to secure the trailer 200 to the first portion 100 (along the trailer 150) in its second position P2 so that the toy vehicle launcher 10 is in the second configuration C2.

Now referring to only FIG. 4, as mentioned, in at least some embodiments, the first portion 100 includes at least a portion of launching mechanism 115. In the depicted embodiment, the first portion 100 includes any components that are directly actuated by an actuation of the launching mechanism 115 and, thus, may be described as including the entire launching mechanism 115. However, the second portion 200 also includes components that are indirectly actuated by an actuation of the launching mechanism 115 (e.g., caused to move due to an actuation of a component that is directly actuated) and, thus, the first portion 100 and second portion 200 may also be described as each including a portion of the launching mechanism 115.

More specifically, in the depicted embodiment, the top 140 of the cab 110 is depressible towards the base 130 of the cab 110 and, thus serves as an actuator 142. That is, the top 140 is a depressible portion that serves as actuator 142. Thus, a child can actuate the actuator 142 by pressing or hitting any portion of the top 140 of cab 110 (and, thus, actuator 142 may be referred to as a slam actuator or some variation thereof). However, in other embodiments, a portion of top 140 or any other portion of the first portion 100 may be depressible or otherwise actuatable to server as the actuator 142.

Additionally, the first portion includes an actuator 142, a kicker 120, a wedge 125 (also referred to as an engagement member 125), and a retaining panel 160 that are mechanically coupled to actuator 142 and, thus, directly actuated by an actuation of the actuator 142. The kicker 120 extends from an opening included in the rear surface 116 of the cab, between two supports 118 that help define the launching area 206 when the reconfigurable toy vehicle launcher 10 is in the launcher configuration C1. The wedge/engagement member 125 is connected to the top 140 via an L-shaped bracket 126. Meanwhile, the second portion includes arms 222 that are actuated by movements of the wedge 125 (which is described in further detail below).

Figure 6:
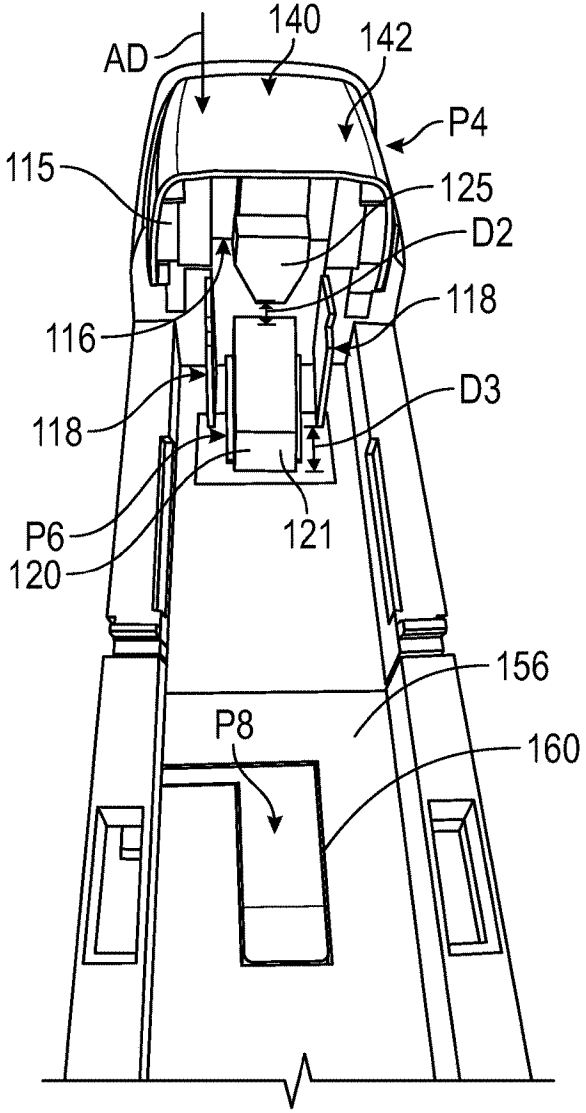
FIG. 6 illustrates a rear perspective view of the first portion of the reconfigurable toy vehicle launcher of FIG. 1 in an actuated position.
Figure 5:
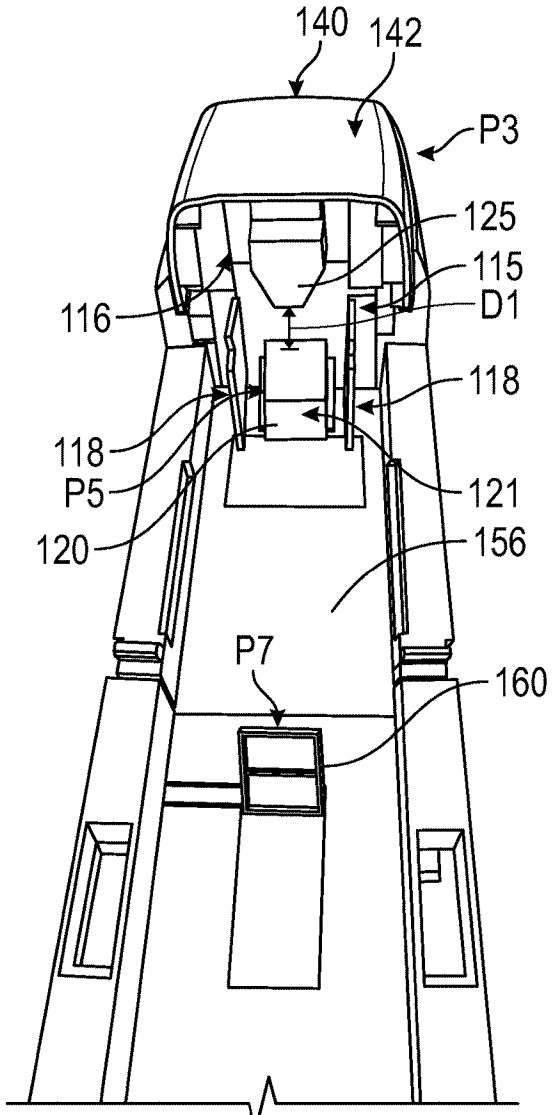
FIG. 5 illustrates a rear perspective view of the first portion of the reconfigurable toy vehicle launcher of FIG. 1 in an unactuated or rest position.

Now turning to FIGS. 5 and 6, these Figures illustrate the components of the launching mechanism 115 included on the first portion 100 between actuations and during an actuation, respectively. Notably, prior to an actuation, the wedge/engagement member 125, the kicker 120, and the retainer panel 160 and are in rest positions P3, P5, and P7, respectively, Then, during an actuation, the wedge 125, the kicker 120, and the retainer panel 160 move to actuated positions P4, P6, and P8, respectively. Each of these actuations are described in further detail below; however, generally, each of the wedge 125, the kicker 120, and the retainer panel 160 are biased (e.g., by springs) to their respective rest positions P3, P5, and P7 and, thus, move back to their respective rest positions P3, P5, and P7 after each actuation. This biasing ensures that the launching mechanism 115 is automatically reloaded between each actuation (via actuator 142) of the launching mechanism 115.

Turning to the specific actuations of the specific components, but now with reference to FIGS. 5-7, between actuations (e.g., before and after an actuation), the wedge/engagement member 125 is disposed in a rest position P3 where the wedge/engagement member 125 is a first distance D1 above the kicker 120, as shown in FIG. 5. However, since the wedge/engagement member 125 is connected to top 140 (via bracket 126), when the top 140 in actuated in direction "AD," the top 140 moves towards the base 130 and the wedge 125 moves with the top 140. This movement decreases the distance between the wedge 125 and the kicker 120 until the wedge 125 reaches an actuated position P4 where the wedge 125 is separated from the kicker 120 by a distance D2 that is smaller than distance D1. That is, in the depicted embodiment, as the top 140 is depressed, the wedge 125 moves downwards with the top 140, so that the wedge 125 moves to an actuated position P4 where the wedge 125 is a distance D2 away from the kicker 120 that is smaller than distance D1. Thus, the wedge 125 is directly actuated by an actuation of the actuator 142

As can be seen in FIG. 7, the base 130 is connected to the top 140 by a resilient, compressible element 143 (e.g., an element including spring) that allows the top 140 (and wedge 125) to move towards the base 130, but also biases the top 140 and the wedge 125 towards their rest positions (e.g., position P3 for the wedge). Thus, when a user is no longer actuating the actuator 142 (e.g., no longer pressing downwards on top 140), the wedge 125 will automatically move upwards, towards its rest position P3.

Next, and still referring to FIGS. 5-7, when the kicker 120 is in a rest position P5, a distal end 121 of the kicker 120 is generally aligned with distal ends of supports 118. Then, during an actuation of the actuator 142 (e.g., a downwards depression of the top 140), movement of the resilient, compressible element 143 causes a mechanical linkage 119 to push the kicker 120 out of the cab 110, beyond the rear end 116 of the cab 110, until the kicker 120 reaches an actuated position P6. Thus, the kicker 120 is directly actuated by an actuation of the actuator 142. In the actuated position P6, the distal end 121 of the kicker 120 is disposed a distance D3 beyond the supports 118. The linkage 119 and/or the kicker 120 is biased towards a rest position so that the kicker 120 is pulled back to its rest position P5 after an actuation (e.g., after a user releases pressure from the top 140).

Third, and still referring to FIGS. 5-7, when the retainer panel 160 is in a rest position P7, the retainer panel extends upward, and generally orthogonal to, the floor 156 of the trailer 150. Then, during an actuation of the actuator 142 (e.g., a downwards depression of the top 140), movement of the resilient, compressible element 143 causes a mechanical linkage 161 to rotate the retainer panel 160 downwards into an actuated position P8 where the retainer panel 160 is substantially aligned with the floor 156 of the trailer 150. Thus, the retainer panel 160 is directly actuated by an actuation of the actuator 142. The linkage 1616 and/or the retainer panel 160 may be biased towards its rest position so that the retainer panel 160 is rotated back to its rest position P7 after an actuation (e.g., after a user releases pressure from the top 140).

Now turning to FIG. 8, this Figure illustrates a bottom view of the trailer 200. As mentioned, in the depicted embodiment, the bottom 230 is largely open and the interior compartment 250 includes a guide 232 configured to receive toy vehicle 30. As can be seen in FIG. 8, the guide 232 includes a tapered section 252 disposed adjacent the rear end 212 of the trailer 200 and includes a retaining member 234 disposed adjacent the front end 202 of the trailer 200. The tapered section 252 may filter launchable to vehicles 30 into the remainder of the guide 232, which may have a width configured to retain launchable toy vehicles 30 in a vertical stack when the trailer 200 is positioned in the magazine position P1.

In the depicted embodiment, a bottom (e.g., the face on top in FIG. 8) of the guide 232 is open but includes edges that extends inwards to create a front opening with a width "W" that is smaller than a width of the launchable toy vehicles 30. Thus, the toy vehicles 30 will not be able to exit the guide 232 through bottom 230 and, instead, will only be able to enter and exit the guide 232 via the opening 203 at the front end 202 of the second portion 200 or the opening 214 at the rear end 214 of the second portion 200. In fact, in other embodiments, the bottom of the guide 232 may be completely enclosed with a solid or transparent cover (which may be removable or fixed to the inner guide 232). Moreover, in still other embodiments, the trailer 200 need not include an inner guide 232 and the bottom 230 may be partially closed to provide an opening with a width W (or smaller) or may be completed closed, provided the trailer 200 can still vertically stack vehicles 30 when the second portion 200 is in the magazine position P1.

Still referring to FIG. 8, but now with reference to FIGS. 9 and 10 as well, the front end 202 of the second portion 200 includes a number of features that allow the second portion 200 to: (1) define a launching area 206 when the second portion 200 is in the magazine position P1; and/or (2) complete the launching mechanism 115 when the second portion 200 is in the magazine position P1.

First, the first end 202 of the second portion 200 includes supports 204 that extend beyond the first end 202. The supports 204 cooperate with the supports 118 to position the retaining member 234 at a height "H" above a support surface, such as the floor 156 of the trailer 150, that is high enough to allow one, but not more, of the toy vehicles 30 to travel beneath the retaining member 234. Put another way, in the depicted embodiment, the supports 204 cooperate with the supports 118 to create a launching area 206 (however, in other embodiments, the second portion 200 may define the launching area 206 on its own). When a toy vehicle 30 is disposed in the launching area 206 (e.g., once a vehicle passes through the opening 203 disposed at the front end 202 of the second portion 200), the kicker 120 may be able to impact a rear end of the toy vehicle 30 and propel the toy vehicle 30 forwardly, under the retaining member 234.

Second, and now referring to only FIGS. 9 and 10 (notably, FIG. 10 is upside-down with respect to FIG. 9 so that, for example, the bottom 230 is shown on top in FIG. 10), the first end 202 of the second portion 200 includes arms 200 that are actuatable by the wedge/engagement member 125 when the second portion 200 is in its magazine position P1 (and, thus, are indirectly actuatable by the actuator 142). The arms 222 are generally embedded in the top 220 and opposite sidewalls 236 of the second portion, and each have a pivot point approximately aligned with a corner between the top 220 and its sidewall 236. That is, the arms 222 are mounted on axles 225 that extend, at least approximately, into opposite edges of the top 220. Each arm 222 includes a vehicle engagement end 223 and an actuatable end 226. An interior side (e.g., a side facing the interior compartment 250) of the vehicle engagement end 223 includes a grip 224 and an exterior side of the actuatable end 226 includes a protrusion 228.

Figure 11B:
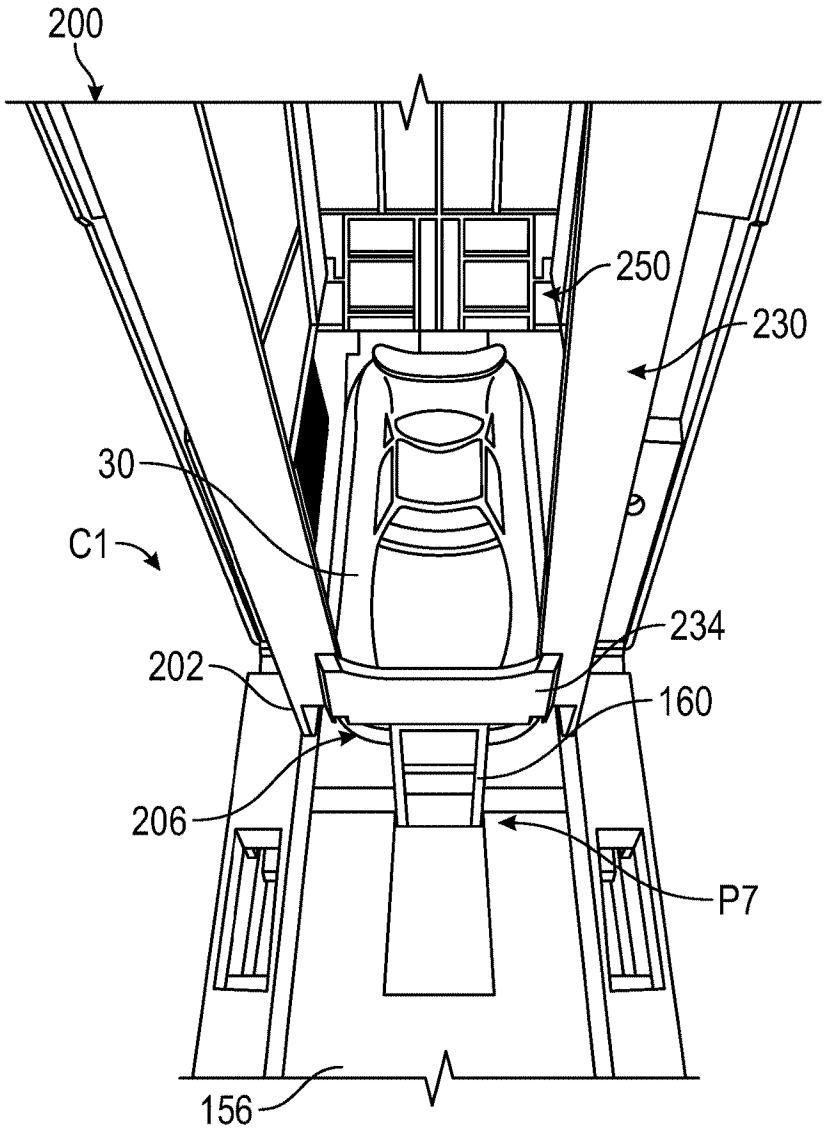
FIGS. 11B and 12B illustrate close-up rear views of a launching area that is defined when the reconfigurable toy vehicle launcher of FIG. 1 is in the launcher configuration, with FIG. 11B illustrating the launching area between actuations and FIG. 12B illustrating the launching area during an actuation.
Figure 11A:
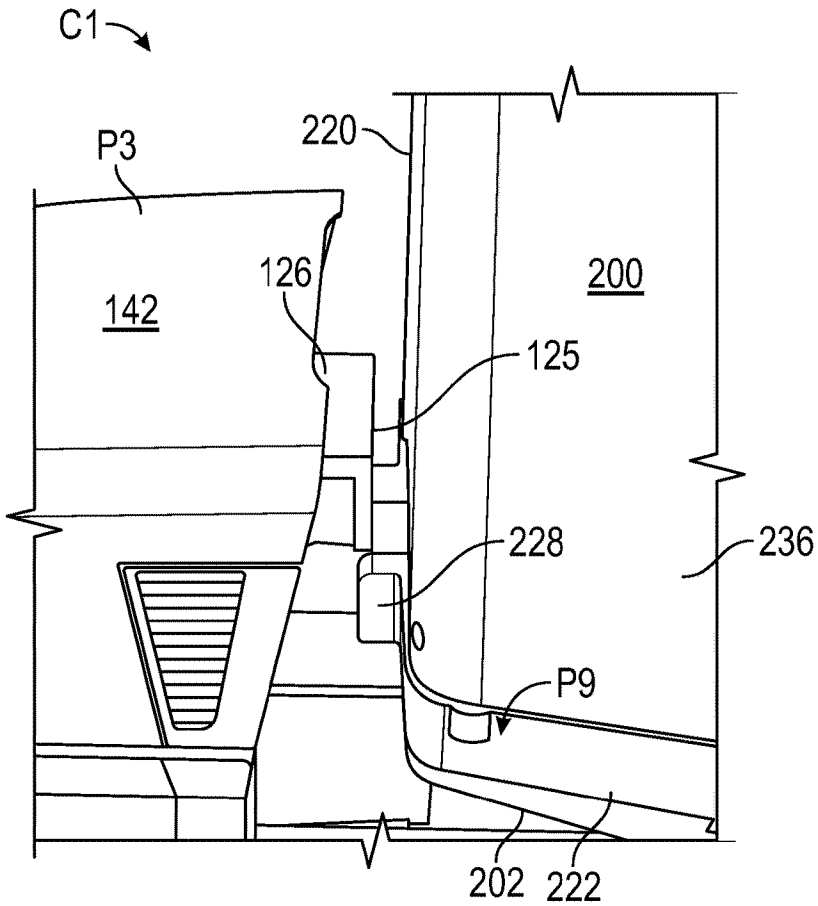
FIGS. 11A and 12A illustrate close-up side views of components of a launching mechanism that is actuatable when the reconfigurable toy vehicle launcher of FIG. 1 is in the launcher configuration, with FIG. 11A illustrating these components between actuations and FIG. 12A illustrating these components during an actuation.
Figure 12B:
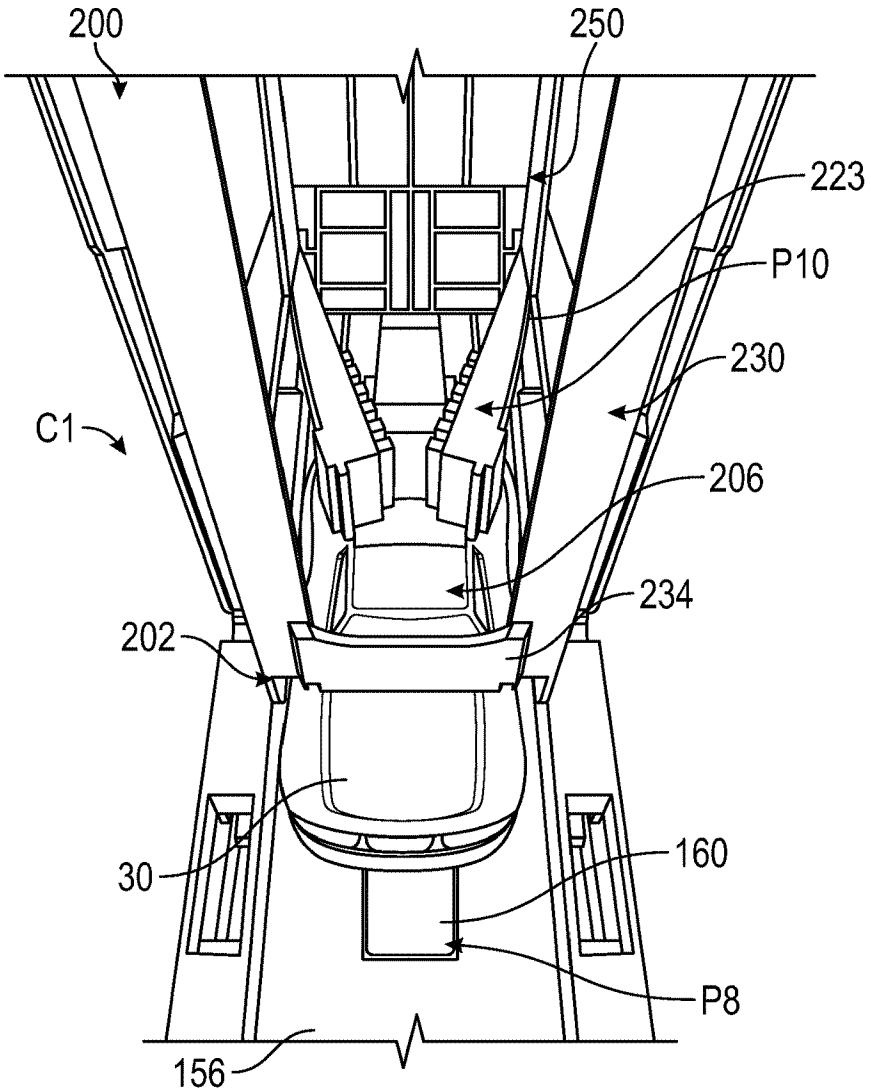
Figure 12A:
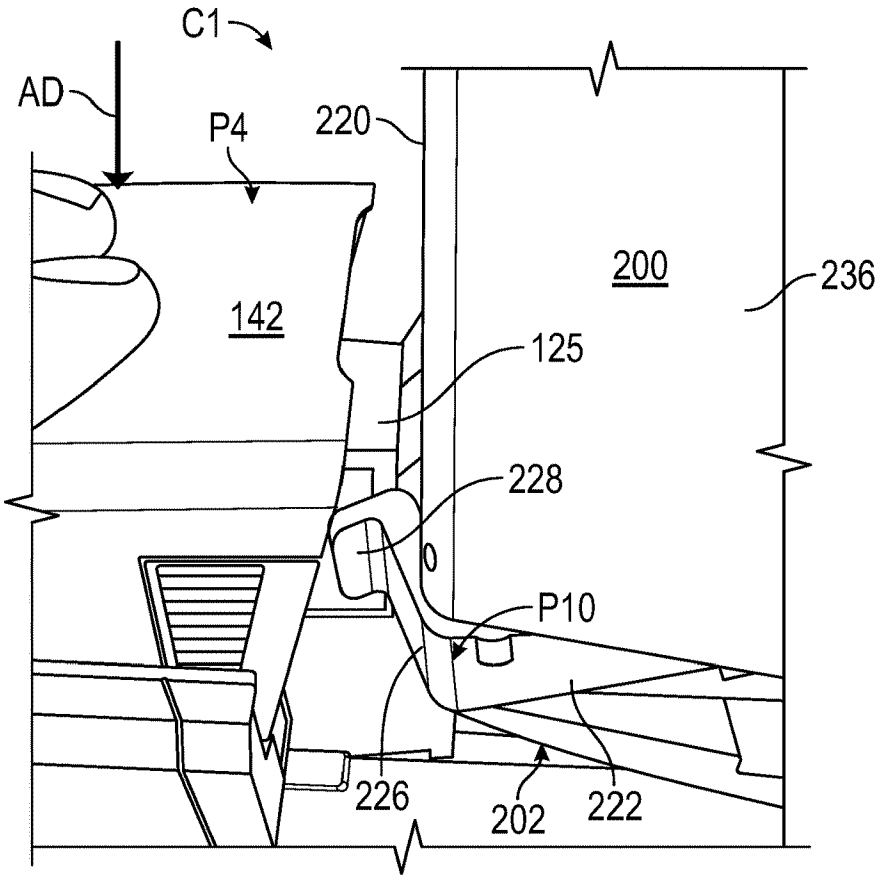

Now referring to FIGS. 11A, 11B, 12A, and 12B, but with continued reference to FIGS. 8-10, generally, the arms 220 are actuated as the wedge 125 moves into its actuated position P3. FIGS. 11A and 11B illustrate, from different perspectives, the arms 222 and wedge 125 prior to or subsequent to an actuation while FIGS. 12A and 12B illustrate, from different perspectives, the arms 222 and wedge 125 during an actuation. As can be seen in FIGS. 11A-B, since the wedge 125 is mounted to the rear surface 116 of the cab 110 of a L-shaped bracket 126, the wedge is spaced apart from the rear surface 116 of the cab 110 and is adjacent or abutting the top 220 of the second portion 200 when the second portion 200 is in the magazine configuration P1 (e.g., when the reconfigurable toy vehicle launcher 10 is in the first configuration C1). Thus, when the actuator 142 is actuated, the wedge 125 moves into contact with the protrusions 228 included on arms 222 and drives the actuatable ends 226 of the arms 222 away from each other, as can be seen in FIG. 12A.

Since the arms 222 are pivotally mounted on axles 225, driving the actuatable ends 226 of the arms 222 away from each other causes the engagement ends 223 of the arms 222 to rotate towards each other, as can be seen in FIG. 12B (and is emphasized when viewed in comparison with FIG. 11B). That is, when the actuator 142 is actuated, a direct actuation of the wedge 125 causes the wedge 125 to move the arms 222 from a rest position P9 to an actuated position P10. The arms may be biased, for example, by a spring, to their rest position P9.

Figure 13:
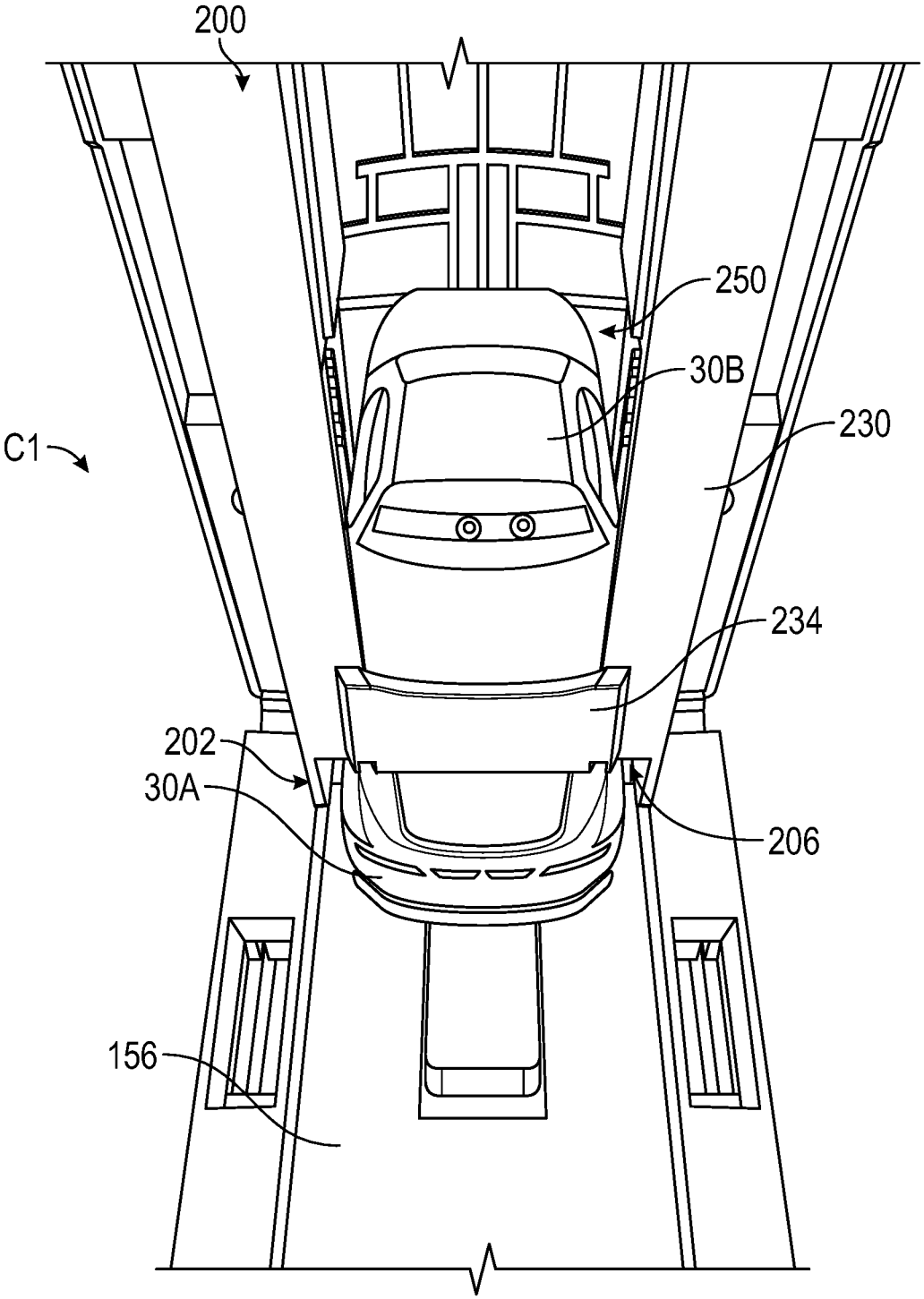
FIG. 13 illustrates another close-up view of the launching area during an actuation.

Still referring to FIGS. 11A, 11B, 12A, and 12B, but now with reference to FIG. 13 as well, when the reconfigurable toy vehicle launcher 10 is in its launching configuration C1 and multiple launchable toy vehicles 30 are loaded into the interior compartment 250 of the second portion 200 (and/or the inner guide 232), a first car 30A loaded into the compartment 250 will fall into the launching area 206. A second car 30B loaded into the compartment 250 will then sit atop of the first car 30A. Then, when the actuator 142 is actuated, the various components of the launching mechanism 115 (e.g., the wedge 125, the kicker 120, and the retainer panel 160 or, from another perspective, the wedge 125, the kicker 120, the retainer panel 160, and the arms 222) cooperate to launch the first vehicle 30A while retaining the second vehicle 30B in a position above the launching area 206.

More specifically, the retainer panel 160 opens the launching area 206 by pivoting towards and onto/into the floor 156, the kicker 120 extends into the first toy vehicle 30A to propel the first vehicle 30A out of the launching area (over the retainer panel 160, floor 156, and ramp 175), and the wedge 125 actuates the arms 220, causing the arms 220 to clamp onto the second vehicle 30B and prevent the second vehicle 30B from impeding the launch of the first vehicle 30A. In at least some embodiments, the arms 222 are aligned with the retainer panel 234 and the retainer panel 234 prevents the clamping force generated by the arms 222 from driving the car out of the second portion 200 through the bottom 230.

Once a user releases the actuator 142 (e.g., releases pressure on the top 240), the biasing of various components will reset the launching mechanism 115 (and biasing in the arms 222 may reset the arms 222 if the arms 222 are considered to be distinct from the launching mechanism 1115). This will clear the launching area 206 (since the kicker 120 will retract) and release the second vehicle 30B so that the second vehicle 30B can fall into the launching area 206. The retainer panel 160 will prevent the second vehicle 30B from exiting the launching area 206 until a user re-actuates the actuator 142. Once a user re-actuates the actuator 142, the launching mechanism 115 sequentially launches the second vehicle 30B (which can be nearly immediately after the first vehicle 30A). This process may be repeated for any number of cars that are disposed in the second portion 200 (e.g., for the capacity of the "magazine" 200).

Once a user has finished sequentially launching launchable toy vehicles 30, the user may collect the toy vehicles 30 and reload the vehicles into the second portion 200 (with the second portion 200 attached or detached from the first portion 100). The user can then re-launch the toy vehicles 30 or reposition the second portion 200 into the second position P2 to configure the reconfigurable toy vehicle launcher 10 in a toy or storage configuration (e.g., the second configuration C2). Advantageously, once the user configures the reconfigurable toy vehicle launcher 10 in the second configuration C2 the user will not be able to accidentally launch toy vehicles 30. Thus, the user can transport the toy vehicles without worrying about accidentally hitting the actuator 142. Alternatively, if the user cannot or does not collect the launchable toy vehicles 30, the user can configure the reconfigurable toy vehicle launcher 10 in the second configuration C2 and play with the reconfigurable toy vehicle launcher 10 as a toy 40. Thus, the reconfigurable toy vehicle launcher 10 will not lack play value if the launchable toy vehicles 30 are lost or otherwise irretrievable.

Although the disclosed inventions are illustrated and described herein as embodied in one or more specific examples, it is nevertheless not intended to be limited to the details shown, since various modifications and structural changes may be made therein without departing from the scope of the inventions. For example, in some embodiments, various structural features of the launching mechanism included in U.S. Pat. No. 9,731,210 (discussed in the Background section above) may be included or incorporated into the launching mechanism provided herein. In addition, various features from one of the embodiments may be incorporated into another of the embodiments. Accordingly, it is appropriate that the invention be construed broadly and in a manner consistent with the scope of the disclosure.

Additionally, it is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

What is claimed is:

1. A toy vehicle launcher, comprising:

a first portion including at least a portion of a launching mechanism, a first set of female connectors, and a second set of female connectors; and a second portion including, a first end having a first set of male connectors, a second end, a compartment configured to receive a set of launchable toy vehicles, a second set of male connectors disposed between the first end and the second end, and supports that extend beyond the compartment from the first end, wherein the second portion is: detachable from the first portion and reconfigurable with respect to the first portion, between (1) a first position where the second portion is in a first orientation in which the first set of male connectors selectively mate with the first set of female connectors and where the supports define a launching area from which the launching mechanism can sequentially launch the set of launchable toy vehicles and (2) a second position where the second portion is in a second orientation in which the first portion closes the compartment, and where the second set of male connectors selectively mate with the second set of female connectors.

2. The toy vehicle launcher of claim 1, wherein the first portion and the second portion resemble a toy vehicle when the second portion is disposed in the second position.

3. The toy vehicle launcher of claim 2, wherein the first portion is a tractor unit, the second portion is a semi-trailer, and the toy vehicle launcher resembles a tractor-trailer when the semi-trailer is in the second position.

4. The toy vehicle launcher of claim 1, wherein the toy vehicle launcher is inoperable when the second portion is in the second position.

5. The toy vehicle launcher of claim 1, wherein the launching mechanism comprises:

an actuator; and a kicker that, in response to a sequential actuation of the actuator, extends into the launching area defined by at least the second portion when the second portion is in the first position so that the kicker launches a particular toy vehicle of the set of launchable toy vehicles that is disposed in the launching area.

6. The toy vehicle launcher of claim 5, wherein the launching mechanism further comprises an engagement member and the second portion further comprises:

a set of arms, wherein in response to the sequential actuation of the actuator, the engagement member actuates the set of arms to prevent toy vehicles of the set of launchable toy vehicles disposed above the particular toy vehicle from falling downwards into the launching area during the sequential actuation.

7. The toy vehicle launcher of claim 5, wherein the launching mechanism further comprises:

a retainer panel configured to retain the particular toy vehicle in the launching area until the actuator is actuated.

8. The toy vehicle launcher of claim 1, wherein the first portion includes a depressible portion and, when the second portion is in the first position, sequential depressions of the depressible portion cause the launching mechanism to sequentially launch the set of launchable toy vehicles along the first portion and away from the toy vehicle launcher.

9. The toy vehicle launcher of claim 1, wherein when the second portion is in the first position the set of launchable toy vehicles are stacked vertically within the second portion.

10. The toy vehicle launcher of claim 1, wherein the second portion is a magazine that can be loaded with the set of launchable toy vehicles.

11. A toy comprising:

a first toy vehicle including:

a first portion with an actuator; and a second portion that is removably coupleable to the first portion in a first configuration via a first set of male connectors, and a second configuration via a second set of male connectors, wherein the second portion has a first orientation in the first configuration and a second orientation in the second configuration; and one or more second toy vehicles that are sized to fit within the second portion, wherein when the second portion is in the first configuration the one or more second toy vehicles can be sequentially launched from the second portion in response to sequential actuations of the actuator, and when the second portion is in the second configuration the one or more second toy vehicles are stored within the second portion.

12. The toy of claim 11, wherein the first portion is a tractor unit, the second portion is a semi-trailer, the first configuration is a launcher configuration and the second configuration is a tractor-trailer configuration.

13. The toy of claim 11, wherein when the second portion is in the first configuration, the first portion and the second portion form a launching mechanism that sequentially launches the one or more second toy vehicles away from the toy in response to the sequential actuations of the actuator.

14. The toy of claim 13, wherein the launching mechanism comprises:

a kicker that is disposed on the first portion and that, in response to one of the sequential actuations of the actuator, extends into a launching area defined by at least the second portion to launch a particular toy vehicle of the one or more second toy vehicles that is disposed in the launching area.

15. The toy of claim 14, wherein the launching mechanism further comprises:

an engagement member disposed on the first portion; and a set of arms disposed on the second portion, wherein, in response to the one of the sequential actuations of the actuator, the engagement member actuates the set of arms to prevent toy vehicles of the one or more second toy vehicles disposed above the particular toy vehicle from falling downwards into the launching area during the one of the sequential actuations.

16. The toy of claim 11, wherein the first portion includes a depressible top portion and the actuator is actuatable via sequential depressions of the depressible top portion.

17. A toy vehicle launcher, comprising:

a first portion including a first part of a launching mechanism; and a second portion including a second part of the launching mechanism, a first set of male connectors, a second set of male connectors, and a compartment configured to receive a set of launchable toy vehicles, wherein the second portion is: (1) removably coupleable, via the first set of male connectors, to the first portion in a first position where the second portion is in a first orientation, in which the first part of the launching mechanism is aligned with the second part of the launching mechanism so that the launching mechanism can sequentially launch the set of launchable toy vehicles away from the toy vehicle launcher; and (2) removably coupleable, via the second set of male connectors, to the first portion in a second position where the second portion is in a second orientation, in which the first part of the launching mechanism is separated from the second part of the launching mechanism.

18. The toy vehicle launcher of claim 17, wherein the first portion and the second portion provide a toy or a storage solution when the second portion is in the second position.

19. The toy vehicle launcher of claim 17, wherein the launching mechanism is inoperable when the second portion is in the second position.

20. The toy vehicle launcher of claim 17, wherein:

the first part of the launching mechanism comprises:

an actuator; and a kicker that, in response to one sequential actuation of the actuator, extends into a launching area defined by at least the second portion to launch a particular toy vehicle of the set of launchable toy vehicles that is disposed in the launching area; and the second part of the launching mechanism comprises:

a set of arms that, in response to the one sequential actuation of the actuator, prevent toy vehicles of the set of launchable toy vehicles disposed above the particular toy vehicle from falling downwards into the launching area during the one sequential actuation.

* * * * *